US011029134B2

(12) United States Patent
Sharp et al.

(10) Patent No.: US 11,029,134 B2
(45) Date of Patent: Jun. 8, 2021

(54) TARGET CARRIER SYSTEM HAVING ADVANCED FUNCTIONALITY

(71) Applicant: Action Target Inc., Provo, UT (US)

(72) Inventors: David Sharp, Redmond, WA (US); Todd Rupper, Woodland Hills, UT (US)

(73) Assignee: Action Target Inc., Provo, UT (US)

( * ) Notice: Subject to any disclaimer, the term of this patent is extended or adjusted under 35 U.S.C. 154(b) by 103 days.

(21) Appl. No.: 16/237,394

(22) Filed: Dec. 31, 2018

(65) Prior Publication Data

US 2019/0212107 A1 Jul. 11, 2019

Related U.S. Application Data

(60) Provisional application No. 62/614,404, filed on Jan. 6, 2018, provisional application No. 62/619,674, filed on Jan. 19, 2018.

(51) Int. Cl.
*F41J 5/04* (2006.01)
*F41J 9/02* (2006.01)
(Continued)

(52) U.S. Cl.
CPC . *F41J 9/02* (2013.01); *F41J 5/04* (2013.01); *F41J 7/00* (2013.01); *F41J 11/00* (2013.01)

(58) Field of Classification Search
CPC . F41J 5/04; F41J 5/18; F41J 5/20; F41J 7/00; F41J 7/02; F41J 9/00; F41J 9/02; F41J 11/00
See application file for complete search history.

(56) References Cited

U.S. PATENT DOCUMENTS 157,335 A 12/1874 Lyon
429,942 A 6/1890 McBride
(Continued)

FOREIGN PATENT DOCUMENTS

GB 2136932 9/1984
GB 2 187 270 9/1987
(Continued)

OTHER PUBLICATIONS

Caswell International Corp., Product Literature, Copyright 2002.
(Continued)

*Primary Examiner* — Jasson H Yoo
(74) *Attorney, Agent, or Firm* — Bateman IP

(57) ABSTRACT

A system and method for detecting hits to a target carrier and taking corrective measures and/or for detecting hits to a target carried by the target carrier may include one or more sensors or cameras disposed in conjunction with the target carrier. The target carrier may be provided with a processor in communication with a sensor, and the processor may also be in communication with a motor and/or actuator of the target carrier. The sensor may be able to sense hits to the target carrier and send a strike signal to the processor in response to such hits. The processor may then take corrective action, such as causing the target carrier to return to a home position, cause the target actuator to turn or edge the target, and/or send a signal to the range operators that the target carrier has been hit. The target carrier may also be provided with a camera for visualizing a target carried by the target carrier.

24 Claims, 12 Drawing Sheets

(51) Int. Cl.
*F41J 7/00* (2006.01)
*F41J 11/00* (2009.01)

(56) References Cited

U.S. PATENT DOCUMENTS 483,060 A 9/1892 Holm
570,820 A 11/1896 Scratton
631,175 A 8/1899 Parnall
840,610 A 1/1907 Easdale
879,670 A 2/1908 Petry
937,733 A 10/1909 Worrell
950,101 A 2/1910 Green
960,085 A 5/1910 Giles
960,892 A 6/1910 Gates
1,025,944 A 5/1912 Elliott
1,036,879 A 8/1912 Miner
1,207,456 A 12/1916 Whelan
1,348,283 A 8/1920 Koehl
1,424,632 A 8/1922 Fenton
1,517,461 A 8/1924 Robinson
1,540,802 A 6/1925 Ordway
1,543,605 A 6/1925 Gavard
1,559,171 A 10/1925 Knowles
1,657,931 A 7/1926 Krantz
1,640,954 A 8/1927 Mach
1,738,874 A 12/1929 Domingo
1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,547,478 A 7/1948 Lieberman
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Musser
2,838,309 A 6/1958 Merz et al.
2,819,903 A 8/1958 Saunders
2,905,469 A 9/1959 Taylor
2,957,694 A 10/1960 Barber
2,967,712 A 1/1961 Breitenfeldt
3,014,725 A 12/1961 Lewis
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,233,904 A 2/1966 Gillam et al.
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,638,894 A 2/1972 Leutenegger
3,720,411 A 3/1973 Vogelaere
3,755,942 A 9/1973 Samsing
3,802,098 A 4/1974 Sampson et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,129,299 A * 12/1978 Busch ..... F41J 5/056 273/372
4,177,835 A 12/1979 Paley
4,205,847 A 6/1980 Steiger et al.
4,228,569 A 10/1980 Snyder
4,232,867 A 11/1980 Tate, Sr.
4,249,743 A 2/1981 Lee
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,953,875 A 9/1990 Sudit
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A 9/1993 Bateman
5,257,790 A 11/1993 Meadows
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,518,251 A * 5/1996 Liu ..... F41J 5/04 273/371
5,535,662 A 7/1996 Bateman
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,865,439 A 2/1999 Marcuson
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato

(56) References Cited

U.S. PATENT DOCUMENTS

| | | | |
|---|---|---|---|
| 5,951,016 | A | 9/1999 | Bateman |
| 5,963,624 | A | 10/1999 | Pope |
| 5,967,523 | A | 10/1999 | Brownlee |
| 5,988,645 | A | 11/1999 | Downing |
| 6,018,847 | A | 2/2000 | Lu |
| 6,109,614 | A | 8/2000 | Ciarcia |
| 6,223,029 | B1 | 4/2001 | Stenman et al. |
| 6,230,214 | B1 | 5/2001 | Liukkonen et al. |
| 6,283,756 | B1 | 9/2001 | Danckwerth et al. |
| 6,289,213 | B1 | 9/2001 | Flint et al. |
| 6,308,062 | B1 | 10/2001 | Chien et al. |
| 6,311,980 | B1 | 11/2001 | Sovine et al. |
| 6,322,444 | B1 | 11/2001 | Matsui et al. |
| 6,325,376 | B1 | 12/2001 | Elliott et al. |
| 6,328,651 | B1 | 12/2001 | Lebensfeld et al. |
| 6,332,243 | B1 | 12/2001 | Kim |
| 6,378,870 | B1 | 4/2002 | Sovine |
| 6,398,215 | B1 | 6/2002 | Carroll |
| 6,463,299 | B1 | 10/2002 | Macor |
| 6,478,301 | B1 | 11/2002 | Witmeyer |
| 6,484,990 | B1 | 11/2002 | Marshall |
| 6,502,820 | B2 | 1/2003 | Slifko |
| 6,533,280 | B1 | 3/2003 | Sovine et al. |
| 6,543,778 | B2 | 4/2003 | Baker |
| 6,575,753 | B2 | 6/2003 | Rosa et al. |
| 6,588,759 | B1 | 7/2003 | Bateman |
| 6,679,795 | B2 | 1/2004 | Ouimette et al. |
| 6,718,596 | B2 | 4/2004 | Kohlstrand et al. |
| 6,728,546 | B1 | 4/2004 | Peterson et al. |
| RE38,540 | E | 6/2004 | Bateman |
| 6,761,357 | B2 | 6/2004 | Witt |
| 6,776,418 | B1 | 8/2004 | Sovine et al. |
| 6,808,177 | B2 | 10/2004 | Dehart |
| 6,808,178 | B1 | 10/2004 | Sovine |
| 6,896,267 | B1 | 5/2005 | Le Anna |
| 6,975,859 | B1 | 12/2005 | Lambert et al. |
| 6,994,347 | B2 | 2/2006 | Tessel et al. |
| 6,994,348 | B2 | 2/2006 | Lambert et al. |
| 6,994,349 | B2 | 2/2006 | Lambert et al. |
| 7,128,321 | B1 | 10/2006 | Brown |
| 7,134,977 | B2 | 11/2006 | Campbell et al. |
| 7,140,615 | B1 | 11/2006 | Sovine et al. |
| 7,175,181 | B1 | 2/2007 | Bateman et al. |
| 7,194,944 | B2 | 3/2007 | Lambert et al. |
| 7,201,376 | B2 | 4/2007 | Kuosa |
| 7,219,897 | B2 | 5/2007 | Sovine et al. |
| 7,234,890 | B1 | 6/2007 | Marshall et al. |
| 7,264,246 | B2 | 9/2007 | Sovine et al. |
| 7,275,748 | B2 | 10/2007 | Lambert et al. |
| 7,302,768 | B2 | 12/2007 | Gajdacs |
| 7,303,192 | B2 | 12/2007 | Marshall et al. |
| 7,306,230 | B2 | 12/2007 | Lambert et al. |
| 7,322,771 | B1 | 1/2008 | Marshall et al. |
| 7,427,069 | B2 | 9/2008 | Bateman et al. |
| 7,431,302 | B2 | 10/2008 | Bassett et al. |
| 7,469,903 | B2 | 12/2008 | Marshall et al. |
| 7,497,441 | B2 | 3/2009 | Marshall et al. |
| 7,503,250 | B2 | 3/2009 | Lambert et al. |
| 7,556,268 | B2 | 7/2009 | Bateman et al. |
| 7,653,979 | B2 | 2/2010 | Bateman et al. |
| 7,775,526 | B1 | 8/2010 | Lambert et al. |
| 7,793,937 | B2 | 9/2010 | Bateman et al. |
| 7,815,192 | B1 | 10/2010 | Kreiman et al. |
| 7,914,004 | B2 | 3/2011 | Wright et al. |
| 7,950,666 | B2 | 5/2011 | Stincelli et al. |
| 8,016,291 | B2 | 9/2011 | Wright et al. |
| 8,091,896 | B2 | 1/2012 | Lambert et al. |
| 8,128,094 | B2 | 3/2012 | Lambert et al. |
| 8,162,319 | B2 | 4/2012 | Stincelli et al. |
| 8,276,916 | B2 | 10/2012 | Bateman et al. |
| 8,469,364 | B2 | 6/2013 | Bassett et al. |
| 8,485,529 | B2 | 7/2013 | Bateman et al. |
| 8,550,465 | B2 | 10/2013 | Wright et al. |
| 8,579,294 | B2 | 11/2013 | Wright et al. |
| 8,684,361 | B2 | 4/2014 | Henson et al. |
| 8,713,829 | B1 | 5/2014 | Crofford |
| 8,813,401 | B2 | 8/2014 | Diercks |
| 8,827,273 | B2 | 9/2014 | John et al. |
| 9,217,623 | B2 | 12/2015 | Sovine et al. |
| 9,228,810 | B2 | 1/2016 | Bateman et al. |
| 9,574,855 | B2 | 2/2017 | Davis |
| 9,784,538 | B2 | 10/2017 | Sovine et al. |
| 2005/0001381 | A1 | 1/2005 | Lambert et al. |
| 2005/0022658 | A1 | 2/2005 | Bateman |
| 2005/0034594 | A1 | 2/2005 | Parks et al. |
| 2006/0107985 | A1 | 5/2006 | Sovine |
| 2006/0234069 | A1 | 10/2006 | Sovine et al. |
| 2006/0240388 | A1 | 10/2006 | Marshall et al. |
| 2006/0240391 | A1 | 10/2006 | Sovine et al. |
| 2006/0290063 | A1 | 12/2006 | Hagar |
| 2006/0290064 | A1 | 12/2006 | Hagar |
| 2007/0072537 | A1 | 3/2007 | Bateman et al. |
| 2007/0102883 | A1 | 5/2007 | Parks et al. |
| 2008/0185786 | A1 | 8/2008 | Loveland et al. |
| 2008/0277876 | A1 | 11/2008 | Riley |
| 2009/0014961 | A1 | 1/2009 | Bateman et al. |
| 2009/0206551 | A1 | 8/2009 | Parks et al. |
| 2010/0311015 | A1 | 12/2010 | Sovine et al. |
| 2011/0233869 | A1 | 9/2011 | John et al. |
| 2012/0187631 | A1 | 7/2012 | John et al. |
| 2012/0193872 | A1 | 8/2012 | Henson et al. |
| 2012/0247314 | A1 | 10/2012 | Bassett et al. |
| 2012/0274028 | A1 | 11/2012 | Sudbeck et al. |
| 2013/0106059 | A1 | 5/2013 | Larue |
| 2013/0207347 | A1 | 8/2013 | Sovine et al. |
| 2015/0260486 | A1 | 9/2015 | Trimbath |
| 2015/0276356 | A1 | 10/2015 | Cesternino |
| 2015/0292842 | A1 | 10/2015 | Pixton |
| 2015/0330747 | A1 | 11/2015 | Ferrell |
| 2015/0330748 | A1 | 11/2015 | Anzalone |
| 2016/0195371 | A1 | 7/2016 | Bateman et al. |
| 2016/0209173 | A1* | 7/2016 | Dribben ..... F41J 11/00 |
| 2016/0334195 | A1* | 11/2016 | Auld ..... F41J 5/044 |
| 2018/0017362 | A1* | 1/2018 | Rahmanian ..... F41J 9/14 |
| 2018/0202777 | A1* | 7/2018 | Green ..... F41J 1/10 |

FOREIGN PATENT DOCUMENTS

| | | | |
|---|---|---|---|
| GB | 2533147 | A | 6/2016 |
| WO | WO 2010/119440 | A1 | 10/2010 |

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, Jun. 26, 2007.
Porta Target, Product Literature, Circa 2000.
Shootrite, Tactical Training Target, published prior to Apr. 4, 2005.

* cited by examiner

160

| Number of strikes detected by strike sensor | Exemplary Corrective Measures |
|---|---|
| 1 | Display warning message on shooter graphical user, send signal to the range server |
| 2 | Display warning message on shooter graphical user, flash lights on shooter's lane, send signal to the range server |
| 3 | Turn target on edge, send target carrier to home position, send signal to the range server |

165a 165b 165c 168a 168b 168c

*Fig. 7*

TARGET CARRIER SYSTEM HAVING ADVANCED FUNCTIONALITY

TECHNICAL FIELD

The present invention relates generally to the field of firearm shooting ranges, and more particularly to a system for detecting strikes or hits to a target and/or a target carrier and for providing remote information responsive to the strikes.

BACKGROUND

In range shooting, it is important to provide multiple different scenarios to train a shooter (often a soldier or law enforcement officer) to react properly in a number of different situations—thereby protecting both the trainee and the public at large. Target equipment, such as target retrievers, are installed on the ranges to give versatility in training and ease in placing and returning a target. Target retrievers and the like are typically expensive to install and maintain. An inaccurate shooter can cause a retriever to be out of sync with other retrievers and can even do significant damage to a target retriever that may be costly to repair. Further, servicing a target system can typically only be done after closing or when the rest of the range is shut down, due to the danger of entering a range while shooters are active. Thus, it is beneficial if the target equipment and system requires very little servicing.

It can also be difficult to determine which shooter hit the equipment. Even the actual shooter may not know that they hit the target retriever, etc. One current method for detecting whether a target retriever has been hit is for a range worker to spray paint the target retriever prior to each use, and then manually inspect the target retriever after each shooter to determine if any spray paint has been removed by a bullet hit. This can be time consuming and difficult. Additionally, this method does not determine if the hit came from the shooter in the lane of the specific target retriever, or if it came from a shooter on another lane. Accordingly, there is a need to provide an improved method of detecting whether a target carrier has been hit. There is also a need to protect the target carrier from further damage if multiple hits are sustained. It is also beneficial if target systems are programmable to automatically protect the target carrier.

It may also be difficult for a shooter to determine if, during the shooting scenario, they have correctly hit the target which was presented. For example, if the target is downrange several yards, it may be difficult for the shooter to have a visual indication of where, or even if, the shooter hit the target. Thus, there is a need to provide a shooter with a real-time visual indication of a target.

SUMMARY OF INVENTION

The present invention relates to systems and methods for detecting strikes to a target carrier and taking protective measures in response to such strikes. In one embodiment, the system comprises a target carrier, the target carrier having a sensor disposed thereon. The sensor may be in communication with a controller, and the controller may be in control of and/or in communication with the necessary equipment on the carrier to effectuate a response or corrective measure when the sensor detects a strike to the target carrier.

The present invention also relates to a camera system onboard a target carrier. According to one aspect, the camera may be mounted to the target carrier behind a bullet proof steel plate. A piece of rubber or other impact-absorbing material may be placed between the camera and the steel plate to absorb impacts and dampen vibrational energy. According to another configuration, the camera may be provided with a bulletproof case.

In another configuration, the camera may be directed at an angle to view a target carried by the target carrier. The camera may be in communication with a controller to transmit the image of the target in real time to a screen located near the shooter and/or located in a control room. In some configurations, the camera image may be provided with keystone correction. According to another aspect, the camera may be provided with a tilt-shift lens.

According to one configuration, the controller may be in communication with a target carrier motor such that the target carrier may be sent to a "home" position in response to a strike signal received at the controller from the sensor. According to another configuration, the controller may be in communication with a target actuator such that the target may be turned 90 degrees (or placed on edge with respect to a shooter) in response to a strike signal received at the controller from the sensor.

According to another aspect, the sensor may be in communication with a range server such that a range operator is alerted when the sensor detects a strike to the target carrier.

According to another aspect, the system may further comprise a shooter interface that alerts the shooter when the sensor detects a strike to the target carrier.

According to another aspect, the system may comprise a range controller interface which may allow a range operator to select default settings for corrective actions to be taken when a predetermined threshold of strike signals are generated by the sensor, and/or select custom settings for an individual shooter.

According to another aspect, the system may be implemented on a single target carrier without connection to a range server and/or range network. The controller of the target carrier may implement corrective measures in response to a strike signal received from the sensor.

According to yet another aspect, any suitable sensor may be used. In some configurations, more than one sensor and/or more than one type of sensor may be used. For example, the sensor(s) may comprise one or more of an accelerometer, a piezo electric sensor, a microphone, a thermocouple, and a strain gauge sensor.

A method is also described herein to sense hits to a target carrier, and take corrective measures after a predetermined number of hits are detected. Such corrective measures may include actuating a carrier motor to move the carrier to a home position, edging or otherwise altering the position of a target held by the carrier, changing the lighting on the lane of the carrier, sending a signal to the shooter's user interface, and/or sending a signal to the range operator.

BRIEF DESCRIPTION OF DRAWINGS

The following drawings illustrate what are currently considered to be specific representative configurations for carrying out the invention and are not limiting as to embodiments which may be made in accordance with the present invention. The components in the drawings are not necessarily to scale relative to each other. Like reference numerals designate corresponding parts throughout the several views.

The drawings are illustrative and not limiting of the scope of the invention which is defined by the appended claims. The various elements of the invention accomplish various aspects and objects of the invention. Not every element of the invention can be clearly displayed in a single drawing, and as such not every drawing shows each element of the invention.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Figure 1:
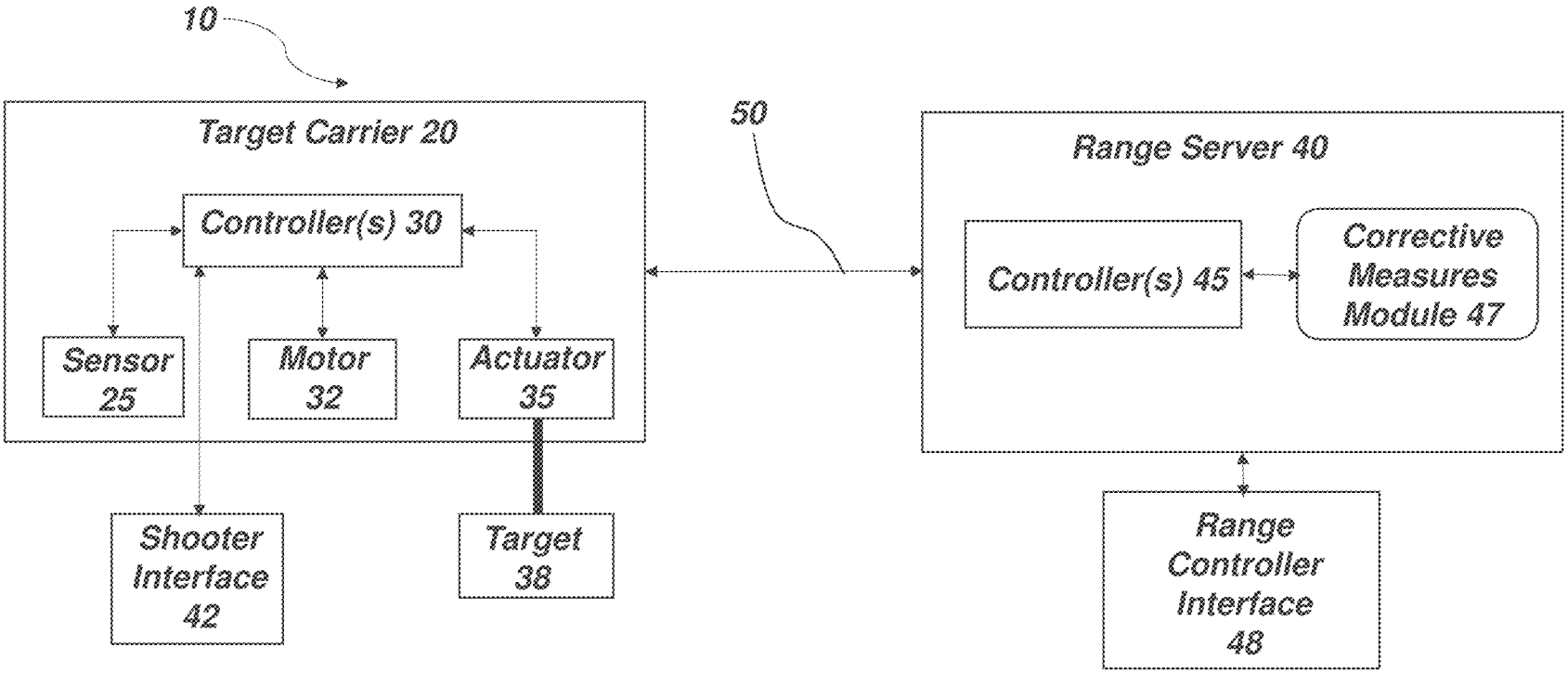
Figure 2:
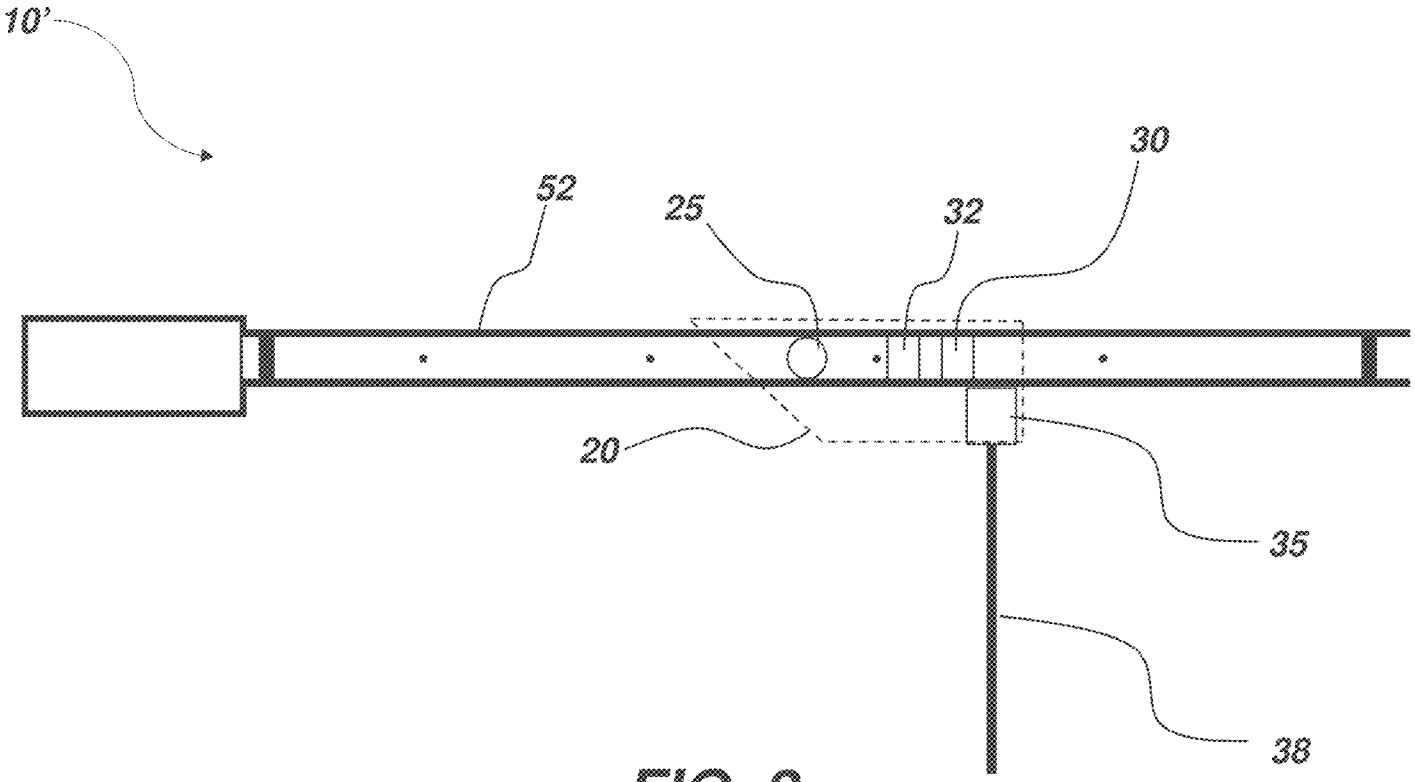
Figure 3:
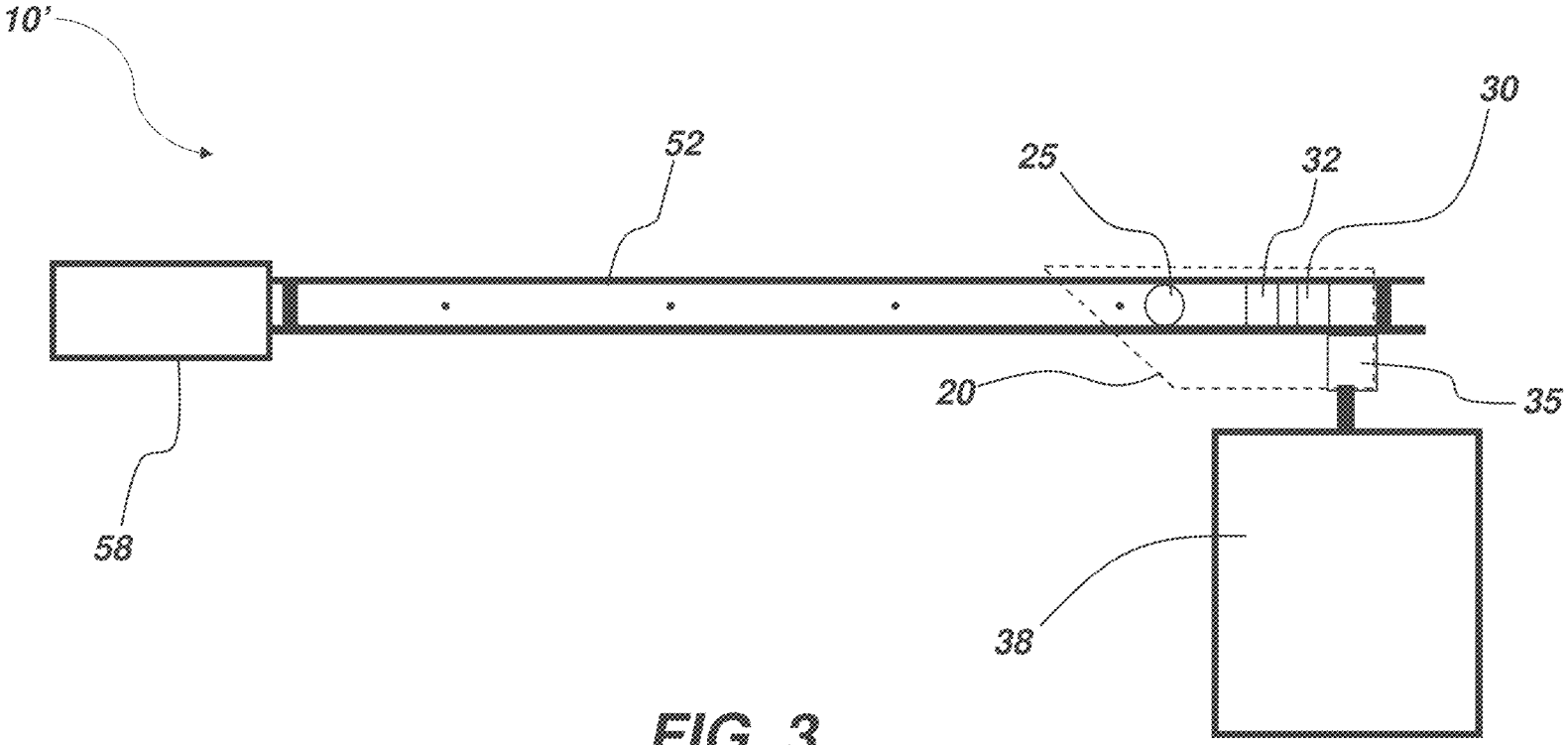
Figure 4:
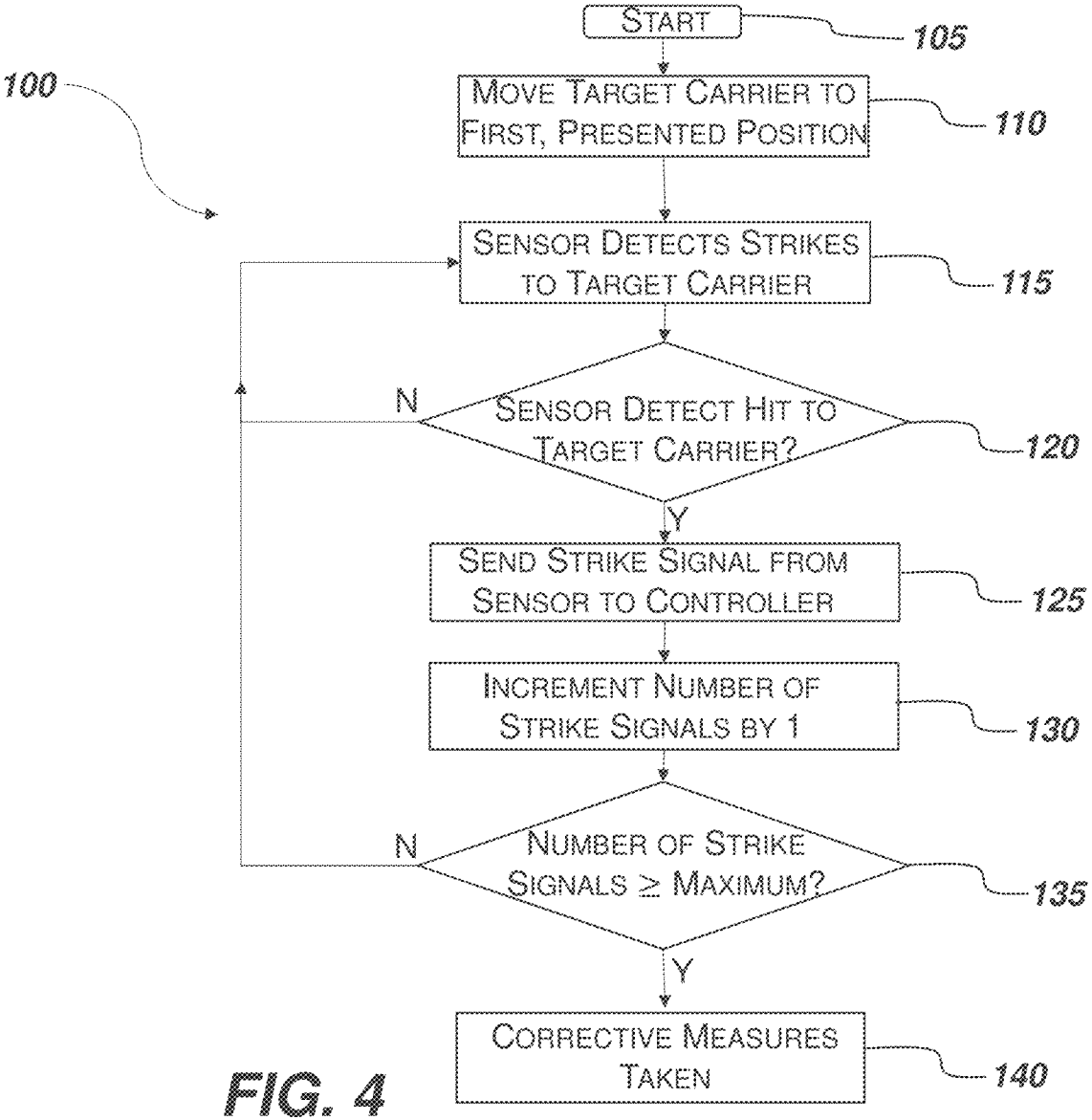
Figure 5:
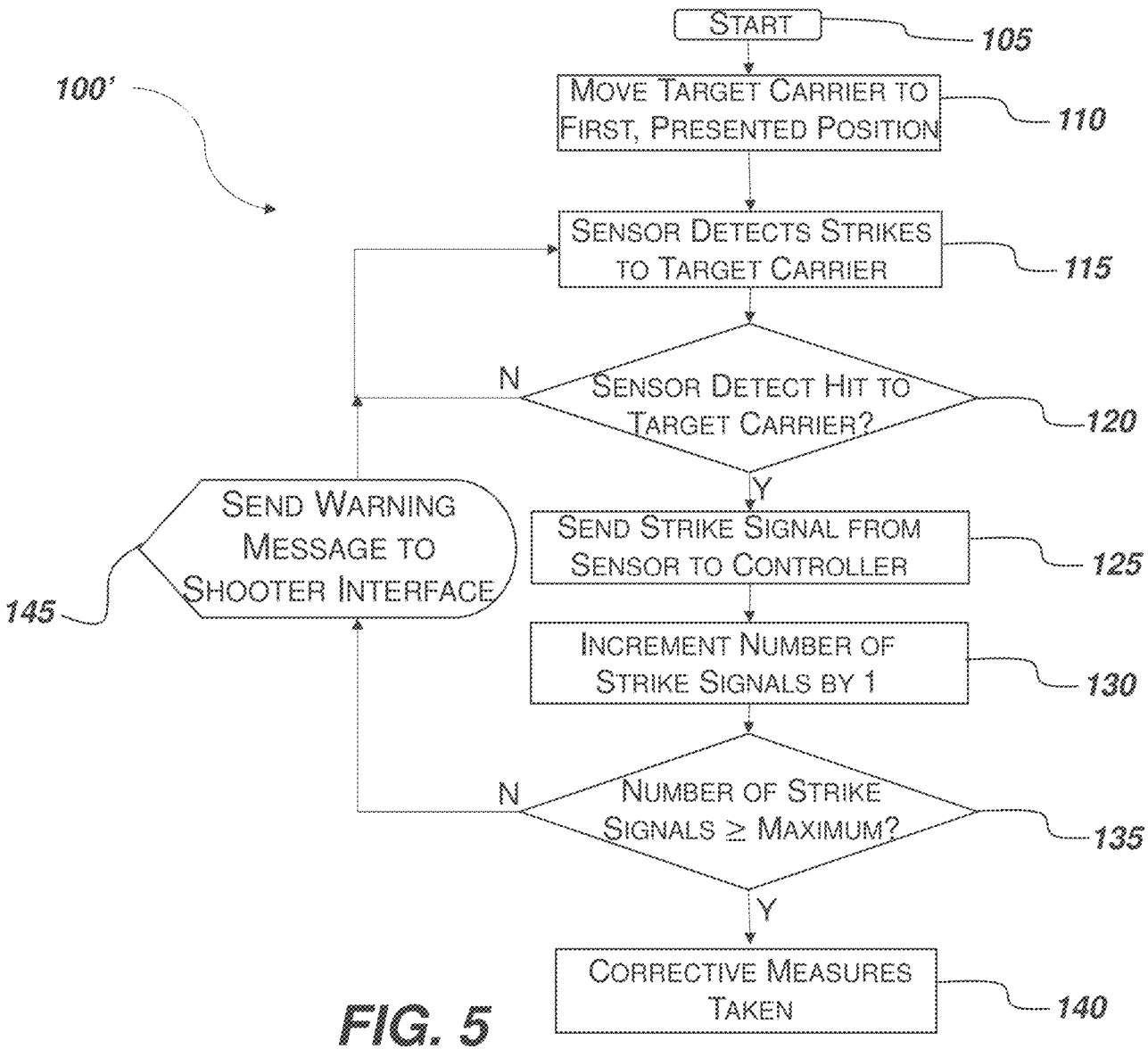
Figure 6:
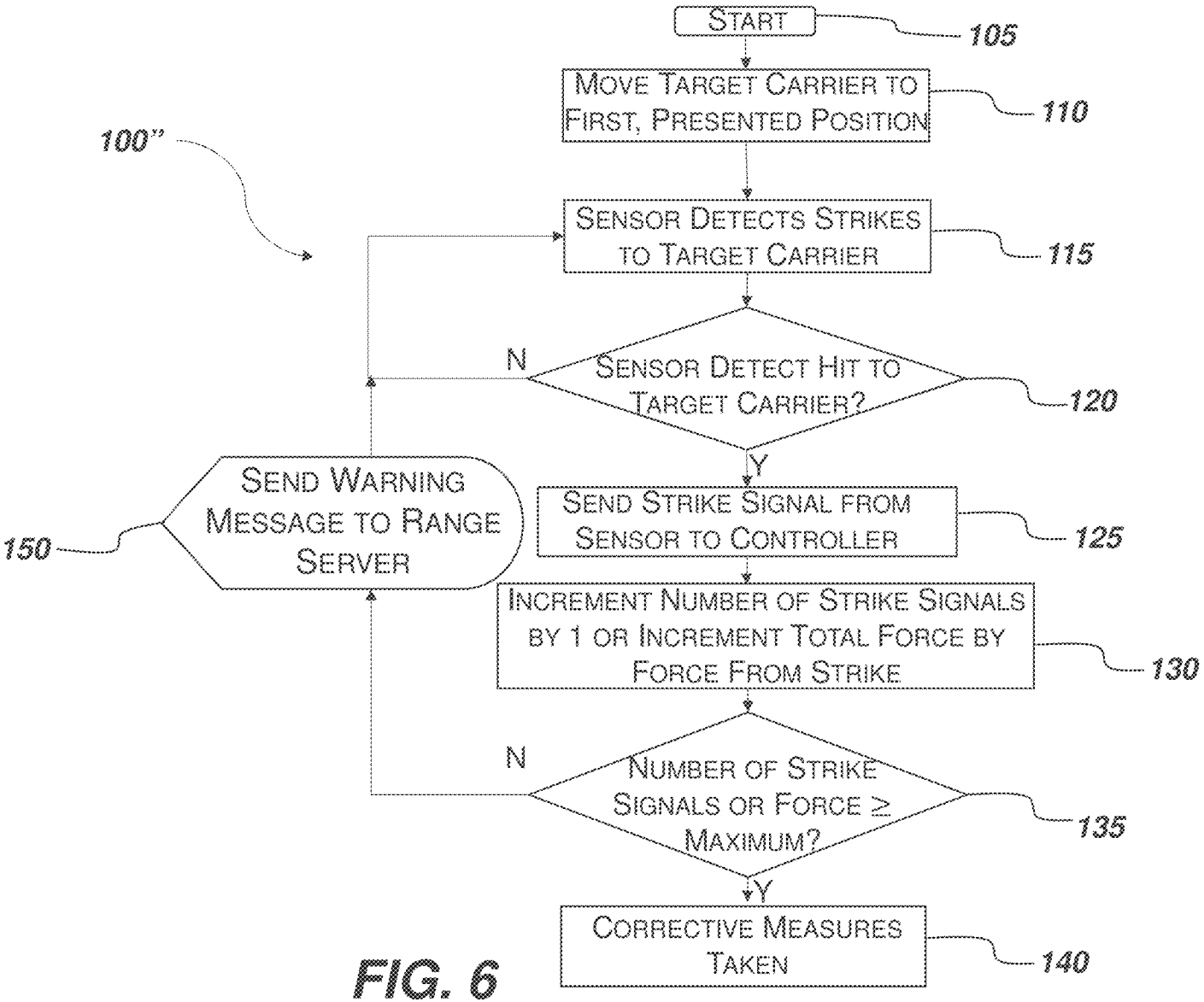
Figure 8:
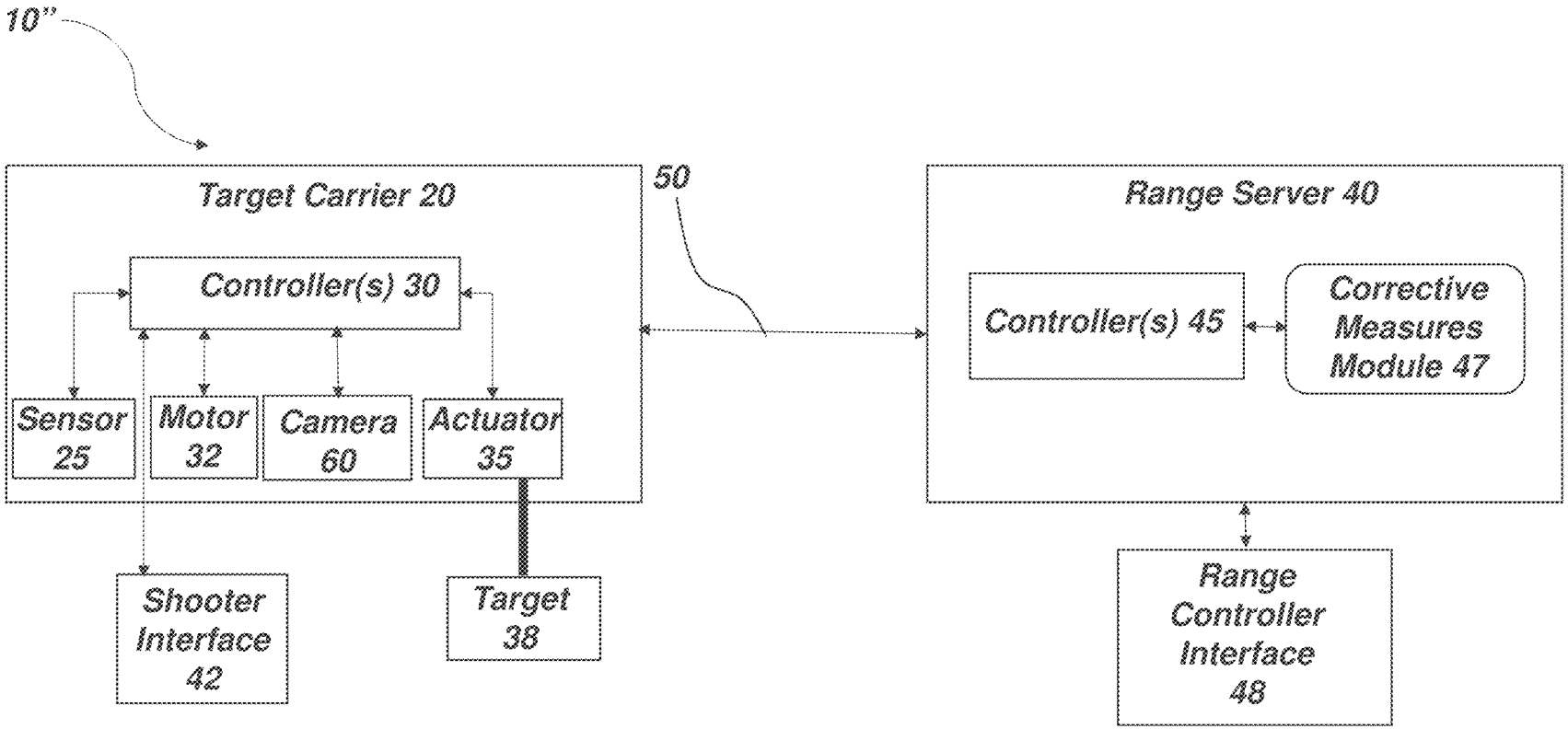
Figure 9:
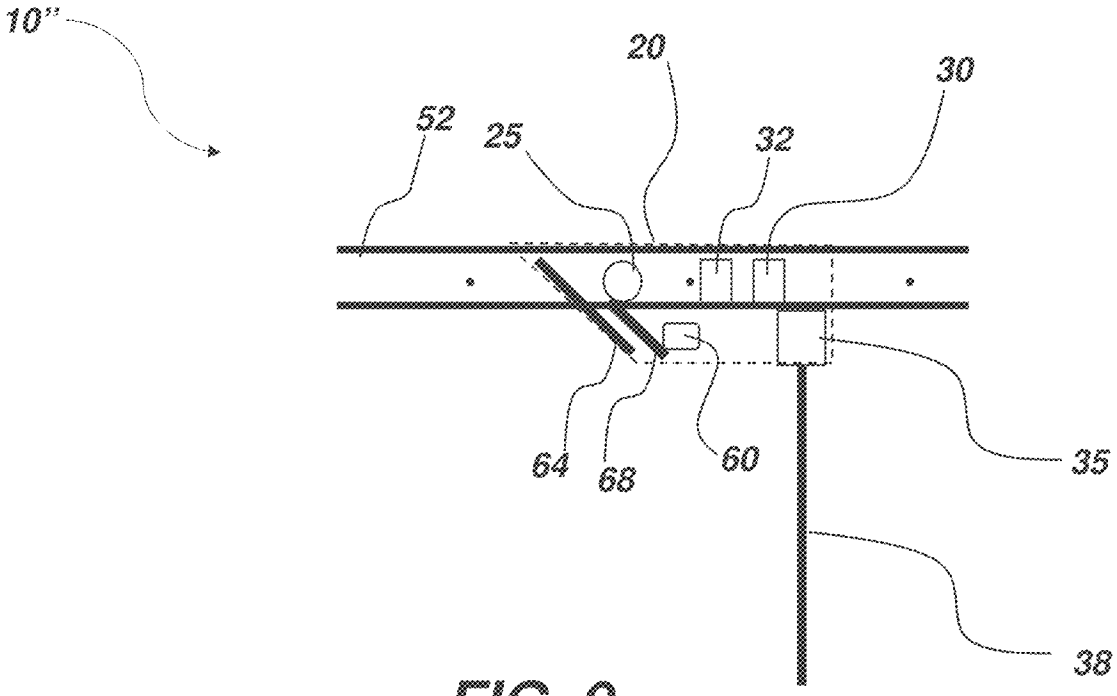
Figure 10:
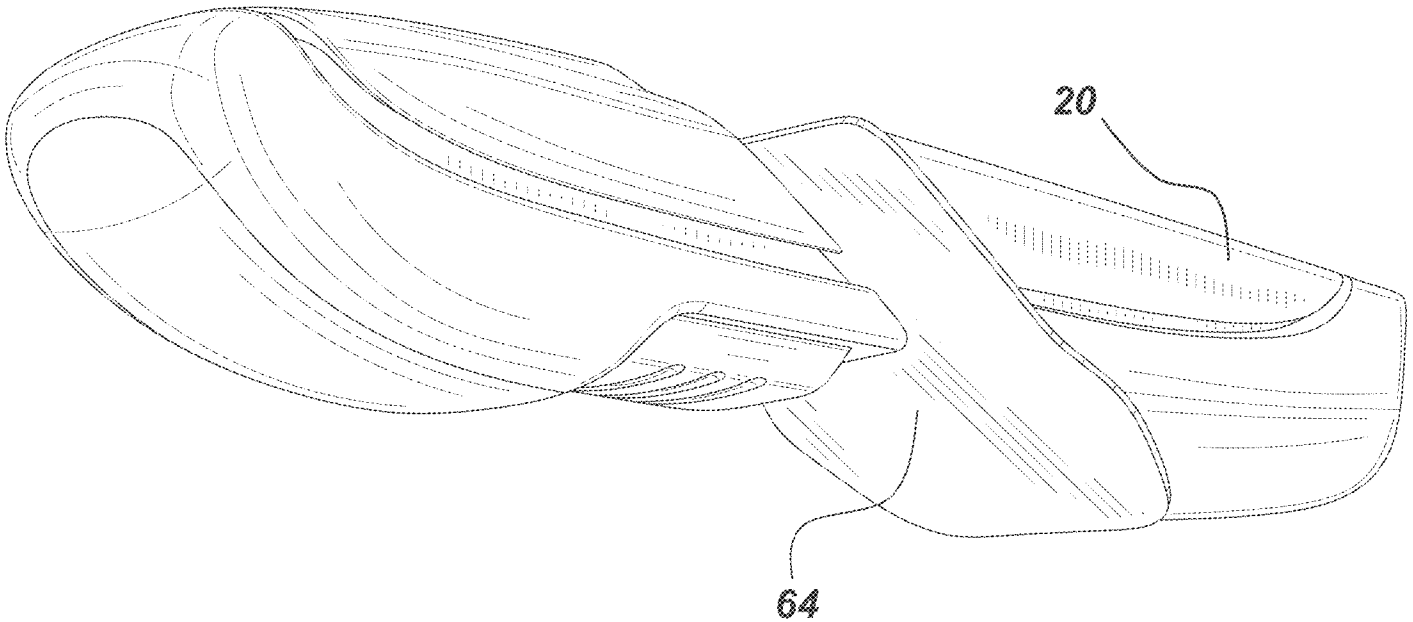

FIG. 1 illustrates a block diagram of exemplary implementation of carrier strike sensor, implemented in a shooting range network, according to an embodiment of the present disclosure;

FIG. 2 illustrates a side schematic view of a target carrier having a strike sensor when a target is in a first, presented position;

FIG. 3 illustrates the side schematic view of a target carrier having a strike sensor of FIG. 2 when a target is in a second, non-presented position in response to one or more strikes to the target carrier;

FIG. 4 is a flowchart illustrating a method of detecting strikes to a target carrier, according to one exemplary embodiment;

FIG. 5 is a flowchart illustrating a method of detecting strikes to a target carrier, according to one exemplary embodiment;

FIG. 6 is a flowchart illustrating a method of detecting strikes to a target carrier, according to one exemplary embodiment;

FIG. 7 is a table illustrating exemplary corrective measures which may be taken based on the number of strikes detected to the target carrier, according to one example configuration;

FIG. 8 is a block diagram of an exemplary implementation of a target carrier having a camera onboard;

FIG. 9 is a schematic view of a target carrier having an onboard camera;

FIG. 10 is a perspective view of a target carrier and docking station; and

Figure 11:
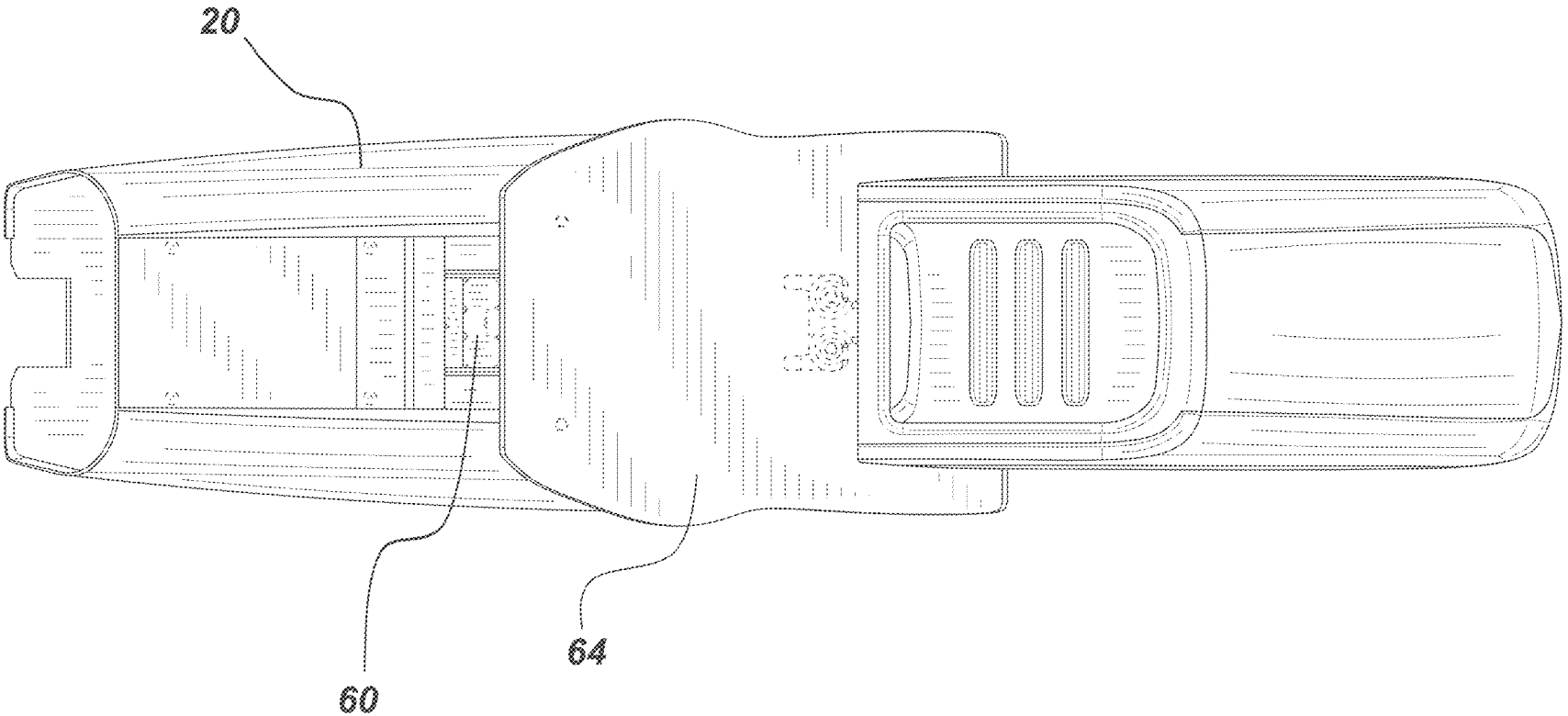
Figure 12:
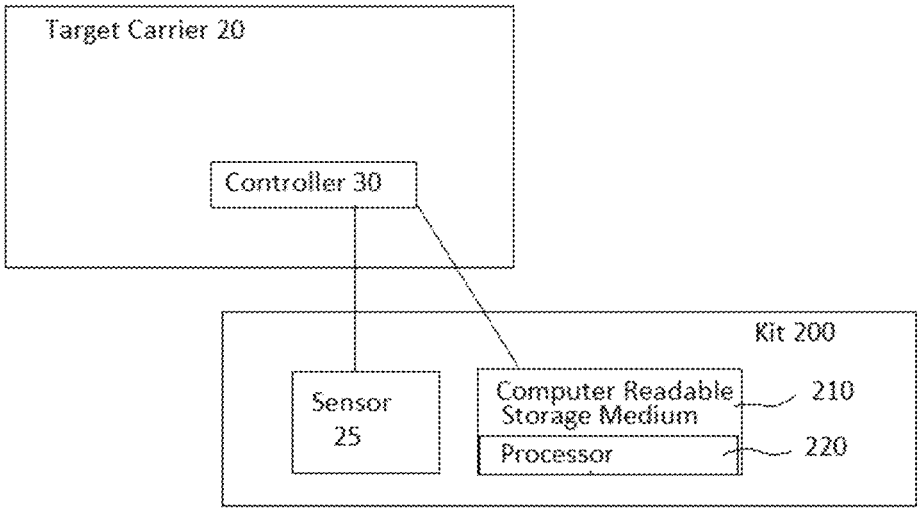

FIG. 11 is a bottom view of the target carrier and docking station of FIG. 10, and FIG. 12 shows a kit for allowing a target carrier to detect and react to being struck.

The following provides a detailed description of particular embodiments of the present invention. Reference will now be made to the drawings in which the various elements of the illustrated configurations will be given numerical designations and in which the invention will be discussed so as to enable one skilled in the art to make and use the invention. It is to be understood that the following description is only exemplary of the principles of the present invention, and should not be viewed as narrowing the scope of the claims which follow, which claims define the full scope of the invention.

It will be appreciated that various aspects discussed in one drawing may be present and/or used in conjunction with the embodiment shown in another drawing, and each element shown in multiple drawings may be discussed only once. For example, in some cases, detailed description of well-known items or repeated description of substantially the same configurations may be omitted. The reason is to facilitate the understanding of those skilled in the art by avoiding the following description from being unnecessarily redundant. The accompanying drawings and the following description are provided in order for those skilled in the art to fully understand the present disclosure, and these are not intended to limit the gist disclosed in the scope of claims.

For a firmware, and/or software implementation of the target carrier strike detection system described herein, the methodologies can be implemented with modules (e.g., procedures, functions, and so on) that perform the functions described herein. Any machine readable medium tangibly embodying instructions can be used in implementing the methodologies described herein. For example, software codes and programs can be stored in a memory and executed by a processing unit. Memory can be implemented within the processing unit or may be external to the processing unit. As used herein the term "memory" refers to any type of long term, short term, volatile, nonvolatile, or other storage devices and is not to be limited to any particular type of memory or number of memories, or type of media upon which memory is stored.

In another firmware and/or software implementation, the functions may be stored as one or more instructions or code on a non-transitory computer-readable medium. Examples include computer-readable media encoded with a data structure and computer- readable media encoded with a computer program. Computer-readable media may take the form of an article of manufacturer. Computer-readable media includes physical computer storage media. A storage medium may be any available medium that can be accessed by a computer. By way of example, and not limitation, such computer-readable media can comprise RAM, ROM, EEPROM, CD-ROM or other optical disk storage, flash memory, magnetic disk storage or other magnetic storage devices, or any other medium that can be used to store reproduce data magnetically, while discs reproduce data optically with lasers. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims. That is, the communication apparatus includes transmission media with signals indicative of information to perform disclosed functions. At a first time, the transmission media included in the communication apparatus may include a first portion of the information to perform the disclosed functions, while at a second time the transmission media included in the communication apparatus may include a second portion of the information to perform the disclosed functions.

It should be noted that the description merely illustrates the principles of the present subject matter. It will thus be appreciated that those skilled in the art will be able to devise various arrangements that, although not explicitly described herein, embody the principles of the present subject matter and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The present disclosure generally relates to a system including a carrier having one or more sensors that allow a hit or strike to the carrier to be detected. The system may automatically indicate if a hit has occurred and take further action (such as edging the target and/or returning the carrier to the home position). As used herein, the term "carrier" is used to refer to any type of target carrier, such as a target retriever, runner, or the like.

The following provides a detailed description of a single target carrier provided with one or more hit detection sensors. It is understood, however, that two or more carriers may be used together to provide a plurality of carriers with hit detection to be used on a shooting range with multiple lanes. Typically, one target carrier will be provided for each lane of a shooting range.

The functions of the various elements shown in the figures, including any functional blocks labeled as "controller(s)," may be provided through the use of dedicated hardware as well as hardware capable of executing software in association with appropriate software. When provided by a controller, the functions may be provided by a single dedicated controller, by a single shared controller, or by a plurality of individual controllers, some of which may be shared. Moreover, explicit use of the term "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), non-volatile storage. Other hardware, conventional and/or custom, may also be included.

One particular embodiment of the present disclosure is shown and described in FIG. 1. FIG. 1 shows a block diagram of some components of one type of system (generally indicated at 10) to detect hits to a target carrier 20. The system 10 may generally comprise a target carrier 20, the target carrier having a sensor 25 disposed thereon. The sensor 25 may be in communication with a controller 30, and the controller 30 may be in control of and/or in communication with the necessary equipment on the carrier 20 (such as a target carrier motor 32 and/or a target actuator 35) to effectuate a response or corrective measure when the sensor 25 detects a strike to the target carrier 20.

In the implementation shown in FIG. 1, the system 10 includes one or more controller(s) 30. The controller 30 may be implemented as one or more microprocessors, microcomputers, microcontrollers, digital signal processors, central processing units, state machines, logic circuitries, and/or any devices that manipulate signals based on operational instructions. Among other capabilities, the controller(s) is configured to fetch and execute computer-readable instructions stored in the memory. Such instructions may include, for example, instructions to move the target carrier 20 via the motor 32 to a home position after one or more strikes to the target carrier 20 are sensed by the sensor 25, and/or move the target actuator 35 to turn target 38, for example, from a presented position to a non-presented position.

The sensor 25 may be any suitable sensor known in the art to detect hits directly to the target carrier 20. The sensor 25 may be able to distinguish between motion of the target carrier 20 due to a bullet strike to the target carrier 20 and motion due to other forces (such as motion which may be caused by motor 32 moving the target carrier 20 over a track, motion caused by movement of target actuator 35 and/or motion caused by hits to target 38). This distinguishing can be accomplished, for example, by calibration/tuning of the sensor 25. The carrier 20 may also be equipped with additional sensor(s) at multiple locations to distinguish the cause of motion of the target carrier 20. In one configuration, the sensor 25 is located behind a front plate of the target carrier 20. In another configuration, the sensor 25 is located on the main printed circuit board of the controller 30. Placement of the sensor(s) 25 may depend on the type of sensor(s) used. Suitable sensors include accelerometers, piezo electric sensors, microphones, thermocouples, strain gauge sensors, etc. Any suitable sensor known in the art may be used.

The sensor 25 may be in communication with the controller (for example, as stated above, the sensor 25 may be attached to the main printed circuit board of the controller) either directly or indirectly, and may send a strike signal to the controller when the sensor 25 detects a hit to the target carrier 20. The controller may effect a change to the target 38 in response to the strike signal (or in response to a predetermined threshold of strike signals) received from the sensor 25. As will be discussed in additional detail below, the predetermined threshold may be based on the number of strike signals indicated (i.e. a threshold zero, on, etc., where exceeding the threshold causes the controller to affect a corrective measure). Alternatively, the predetermined threshold may be based on cumulative force sensed. Thus, for example, the target carrier could be hit by several small caliber, low impact rounds (i.e. .22 long rifle) or a glancing blow without surpassing the threshold, while a single direct hit from a .45 bullet or a 30-06 may exceed the predetermined threshold and cause corrective measures to be taken.

The controller may also send a signal to a range server 40 over a network 50 to alert range operators that a target carrier 20 has been hit. The signal sent from the target carrier controller 30 to the range server may include information, for example, the lane number of the carrier, the number of strikes the carrier has received during a particular shooter's session, the shooting scenario selected by the particular shooter, the type of weapon being used, information relating to the particular shooter, etc.

The network 50 connecting the target carrier controller 30, range server 40, and interfaces 42, 48 may be a wireless or a wired network, or a combination thereof. Depending on the technology, the network 50 includes various network entities, such as gateways, routers, etc.; however, such details have been omitted for ease of understanding.

The range server 40 may have one or more controller(s) 45. Like the controller 30 of the target carrier 20, the range server controller(s) 45 may be implemented as one or more microprocessors, microcomputers, microcontrollers, digital signal processors, central processing units, state machines, logic circuitries, and/or any devices that manipulate signals based on operational instructions. Among other capabilities, the range server controller(s) 45 may be configured to fetch and execute computer-readable instructions stored in the memory. Such instructions may include, for example, instructions to send a signal to a target carrier controller 30 to move the target carrier 20 to a home position after one or more strike signals are received at the range server 40, and/or send a signal to a target carrier controller 30 to move a target 38 to present the edge to the shooter so that the target face is no longer visible after one or more strikes signals are received at the range server 40. It will be appreciated that instructions to send the target carrier 20 to a home position and/or edge the target 38 could be affected either by the controller 30 in the target carrier 20, or by a signal from the range server 40 to the controller 30 in the target carrier 20.

The range server 40 may also comprise a corrective measures module 47 in communication with the controller 45. The corrective measures module 47 may allow range operators to set default corrective measures and/or set unique corrective measures for a particular user.

As explained above, the target carrier 20, may receive a hit as detected by one or more sensors 25 that results in a corrective measure being taken to address a detected strike to the target carrier 20. This may be a user-selectable option by the range operator(s), and may be modified based on user selectable options. Selection of such options may be provided to the range operator(s) via a menu or other graphical user interface 48 to modify and/or program the corrective measures module 47. For example, the range operator(s) may select to allow only one strike to a carrier before a corrective measure is taken, such as placing the target on edge. Alternatively, the range operator(s) may select to allow multiple hits or may select to turn off the option to automatically take corrective measure when the target carrier is hit. Other options include sending a warning to the shooter interface 42 when the target carrier 20 is hit. A default may be set, for example, to take corrective measures after two strikes are detected. Subsequent unique settings for an individual shooter may be changed from the default by the range operator(s). In use the sensors may be configured to estimate the location of the shooter who impacted the target. In some scenarios, the shooter hitting the target carrier 20 may be the shooter in the lane in which the target carrier is operating. One or more strikes may indicate that the shooter is shooting carelessly and is likely to damage or cause excessive wear to the target carrier. Thus, the shooter interface 42 may display a message to the shooter that he or she has struck the target carrier too many times and that the shooter's session had ended. The sensors 25, however, may detect that the impact is coming from a bullet traveling at an angle to the target carrier 20 inconsistent with being fired in the same lane. By determining the location of the target carrier and the direction at which the force impacts the target carrier 20, the system can determine which shooter is likely responsible. For example, the seniors 25 on the target carrier 20 in lane 3 may detect an impact which, when considering the location of the target carrier and the direction of force indicates that the bullet hitting the target carrier actually came from the shooter in lane 1. The shooter interface on claim 1 may then flash a warning to the shooter in that lane that the session with be terminated if the shooter is responsible for another strike to one of the target carriers. Additionally, the same sensors 25 can detect the force of the hit so that the controllers 30/45 may determine whether it is advisable to turn off the target carrier, or simply mark the target carrier for inspection at the end of the day.

According to an implementation of the present disclosure, each of the carriers 20 may be connected to one system 10. However, in another implementation, each of the carriers 20 may include an individual system 10 capable of controlling the target actuator and/or motor of the carrier, etc. associated with that carrier.

Turning now to FIG. 2, there is shown a schematic side view of an alternate system 10' as it may appear during a shooting scenario for a shooter in a particular lane at a shooting range. In this system 10', there is no communication to a range server, but rather all the instructions and protection for the target carrier 20 may reside on the controller 30 of the target carrier 20. Target carrier 20 is shown in dashed lines in FIG. 2 so that interior structures, such as sensor 25, controller 30, and actuator 35 may be seen. FIG. 2 shows a schematic side view of how the system 10' may look as a shooter is actively engaged in a shooting scenario. The shooter may select their scenario, for example, by using a shooter interface 42 (shooter interface 42 not shown in FIG. 2 for clarity, but may be similar to the shooter interface shown in FIG. 1) which may allow selection from a variety of shooting scenarios. Thus, for example, the shooter interface may be a touch screen located in the shooting stall and visible to the shooter. The screen may receive instructions from the shooter and may provide information to the shooter, including whether or not the target carrier has been hit. The target carrier 20 may then move along a track 52 according to the shooting scenario and present a target 38 to the shooter.

As the shooter proceeds, if the target carrier 20 is struck by a bullet, the processor may receive a signal from the sensor 25 that a strike has occurred. In some configurations, a single strike may cause the controller 30 to take corrective measures, such as by sending the target to the "home" position as shown in FIG. 3. In FIG. 3, the target has moved to the very end of the track 52 and has been placed on edge relative to the shooter. In other configurations, the controller 30 is programmed to allow a predetermined number of strikes to occur before the target is sent to a home position and the shooting scenario is ended.

As seen in FIG. 3, the controller 30 received the predetermined number of strikes and actuated the target motor 32 to move the target carrier 20 rearwardly away from the shooter (it will be appreciated that in other configurations the controller 30 may also move the target carrier 20 forwardly until it reaches the docking station 58). In FIG. 3, the controller 30 has also actuated the target actuator 35 to turn the target 38 from its presented position (FIG. 2) to an edged position in which the target is turned about 90 degrees so the edge is facing the shooter. In this position, the target is not presented to the shooter, clearly indicating that the shooting scenario is over. The shooter may be advised that the shooting session is over because he or she struck the target carrier more times than was permitted and may be required to take lessons, pay a fine, attend a training, etc., before being allowed to use the target retrieval system again.

Turning now to FIG. 4, there is shown an exemplary method (generally indicated at 100) for detecting of a strike to a target carrier and subsequent correction actions which may be taken. The order in which the method 100 is described is not intended to be construed as a limitation, and any number of the described method blocks can be combined in any order to implement the method 100, or alternative methods. Additionally, individual blocks may be deleted from the methods without departing from the spirit and scope of the subject matter described herein. Furthermore, the method 100 can be implemented in any suitable hardware, software, firmware, or combination thereof.

After a start 105, the system may move the target carrier to a first, presented position 110 or through a training scenario, etc. The sensor 25 may check for strikes to the target carrier 115. The sensor may perform this check nearly continuously, such as every 0.01 seconds, or as often as desired. It will be appreciated that the logic of the sensor may be programmed to perform this check as often as desired. The sensor then determines if it has detected a hit to the target carrier (120). Where no hit is detected, the sensor may loop to 115 and check again to detect a strike to the target carrier. The loop of checking for strikes and determining if a strike is detected (115, 120) may repeat continuously until the sensor detects a hit to the target carrier.

Alternatively, controllers could be passive and only respond to a signal generated by the sensors when impacted by a bullet.

When the sensor detects a hit to the target carrier, the sensor may then send a strike signal from the sensor to the controller (125). The number of strikes signals may be incremented by one (130). The controller may determine if the number of strike signals is less than the predetermined maximum (135). As stated above, the system may have a default setting that allows, for example, three strike signals before corrective measures are taken. Or, a custom setting may be selected (for example, at the range server a custom setting may be selected for a particular shooter). When the number of strike signals is less than the maximum, the system may return to the loop 115, 120. When the number of strike signals is equal to or greater than the maximum, corrective measures may be taken (140).

The sensors 25 may also be able to detect the magnitude of the strike and use the magnitude of the impact in the calculation as well. For example, a 30-06 bullet will impact the target carrier with far greater force than will a .22 bullet at the same distance due both to the mass of the bullet and the velocity at which it travels for most common rounds. A target carrier we may be hit by 10 rounds fired from a .22 without concern, while a single impact from a 30-06 or more powerful round may suggest deactivating the target carrier until it can be inspected.

Exemplary corrective measures may be sending the target carrier 20 to a home position (such as at either the near end or far end of a track), placing the target 38 on edge so it is no longer presented, sending a signal to the range server 40, sending a message to the shooter interface 42, etc. It will be appreciated that the system may be programmed to have one or more default corrective measures happen at the same time or in a particular order, and/or the system may be programmable by a person in charge of the range to customize the corrective measures for a particular shooter.

Turning now to FIG. 5, there is shown a method 100' wherein the controller 30 sends a warning message to the shooter interface (145) for each strike received that is less than the maximum allowed. This step may be taken immediately after step 120, or at any other point after 120. The warning message sent to the user interface may comprise one or more of an audible sound, a visual warning on the user interface, and/or other visual indications (such as a change in the lighting on the lane of the shooter). While shown in FIG. as being based on the number of strikes 130 which impact the target, the corrective measures 140 could also be based on a cumulative impact force or exceeding a predetermined threshold of force. Thus, for example, the corrective measures could be applied only when an impact significant enough to cause damage has been received, or when the accumulated force of the impacts suggest that the target carrier should be inspected. It will be appreciated that the threshold, etc., at which corrective action may be taken will likely be tied to the durability of the target carrier.

Similarly, FIG. 6 shows an alternate method 100" wherein a warning message is sent to the range server (150) for each strike received that is less than the maximum allowed. It will be appreciated that the steps shown in FIGS. 4-6 could be done simultaneously—with both the shooter and the range server receiving warnings prior to shut down of the target receiver.

FIG. 7 shows a table 160 illustrating various corrective measures which may be taken after each subsequent strike to the target carrier 20 is detected, according to one configuration wherein three strikes to the target carrier is the maximum number of strikes permitted. For example, after one hit is detected 165*a*, the corrective measure may be to display a warning message on a shooter's graphical user interface, and also send a signal to the range server to alert a range operator of the strike 168*a*. After a second hit is detected (165*b*), the warning message may again be displayed on the shooter's graphical user interface, and the signal sent to the range server to alert a range operator of the strike, and additionally flashing the lights on the shooter's lane 168*b*. After a third hit is detected 165*c*, the system may turn the shooter's target on edge, send the target carrier to a home position, and send a signal to the range server alerting the range operator that the maximum number of strikes has been reached and the shooter's lane has been shut down. As with FIGS. 4 and 5, the method could also be conducted using a threshold of force received by rounds hitting the target carrier, with the various corrective measures occurring each time a predetermined threshold is passed.

Various embodiments described also can be practiced without some of the specific details described herein, or with other specific details, such as changes with respect to the ordering of the code flow shown in the figures, different code flows, and the like. Thus, the scope of the techniques and/or functions described are not limited by the particular order, selection, or decomposition of steps described with reference to any particular module, component, or routine.

As mentioned above, in some configurations, the system may be programmed to not only detect a hit or no hit, but the relative force of the hit, and take appropriate corrective steps. For example, if a shooter was using a low impact round such as .22 long rifle, or the hit is minor because it is only a glancing blow as opposed to a direct hit, the system may only send a message to the shooter, having determined that the hits are unlikely to cause significant damage. Thus, the system may allow a greater number of such low-impact hits. In contrast, if the sensors detect a hit from a larger caliber round (such as a .45 caliber or a high velocity round with substantial inertia), such a detected hit may have enough force to cause the target retriever to shut down even if the predetermined number of hits has not been detected. Additionally, while the number of hits allowed has been discussed as three, the actual number of hits used can be decided by the range based on their use profiles, type of equipment, etc., and may be 1, 2 3, 4, 5, or any other number or a combination of a number and detected force of the impact.

According to another aspect of the present disclosure, the target carrier 20 may comprise an onboard camera 60. As seen in FIG. 8, the camera 60 may be in communication with the controller(s) and thereby in communication with a shooter interface 42 and/or a range server 40, as discussed in more detail below.

The camera 60 may be placed at any suitable location on the target carrier 20. In one configuration, the camera is placed behind a steel plate 64 (see FIGS. 9-11) which may be disposed at a downward angle to deflect projectiles away from the functional components of the carrier, such as target actuator 35. Mounting behind the steel plate 64 may offer protection to the camera from bullets. A piece of shock absorbing material 68 may be placed between the camera 60 and the steel plate 64 (such as a shock absorbing polymer, visco-elastic polymer, visco polymers or simply polymers, rubber, neoprene, silicone, Sorbothane®, urethane foam, etc.). In other configurations, the camera may be additionally or alternatively provided with a bullet proof case.

The camera 60 may direct its view towards a target 38 mounted on the target carrier 20. Because the target 38 may typically be located at an angle below camera 60, the camera image output may be provided with keystone correction. Keystone correction may allow the image to be flattened for presentation on a screen as the image would appear if the camera 60 were directly in front of target 38 (instead of located above target 38). In other configurations, the camera 60 may be provided with a tilt-shift lens for optimizing the view of the target 38.

In configurations where the camera 60 is in communication with the target carrier controller 30 (it will be appreciated that the camera 60 may be provided with its own controller or may use the controller of the carrier), the image viewed by the camera 60 may be transmitted in real time to a remote screen. For example, the image may be sent to a screen proximal to a shooter. This may allow the shooter to closely examine the target (which is often several yards away) to see hits to the target.

Additionally, software may be provided which analyzes the visual output of camera 60 to automatically determine if a hit has occurred in a desired area. Such software may also be programmed to send a visual and/or audible alert to the shooter to indicate a hit. For example, when the software determines a hit has occurred, the screen located near the shooter may flash a large message that says "HIT," and/or provide an auditory signal, such as a beep or chime. Other indicators include flashing the lights on the shooter's lane, etc. Similarly, the software may be able to automatically assign a score to a shooter for a particular shooting scenario. This may simplify training scenarios and make it easier for shooters to identify mistakes made during the scenario.

In another configuration, the camera output may be transmitted to a range server 40 for remote viewing. For example, when the training scenario is for police officers, a training officer in a remote room may have access to the camera images of each target for review and analysis.

While the invention has been described in particular with reference to certain illustrated configurations, such is not intended to limit the scope of the invention. The present invention may be embodied in other specific forms without departing from its spirit or essential characteristics. The described configurations are to be considered as illustrative and not restrictive. The scope of the invention is, therefore, indicated by the appended claims rather than by the foregoing description. All changes which come within the meaning and range of equivalency of the claims are to be embraced within their scope.

Described herein is a system for detecting hits to a target carrier, which may comprise: a carrier, the carrier comprising a sensor to detect a strike to the carrier and send a strike signal to a controller in response to the strike signal; the controller in communication with the sensor and a actuator, the controller configured to actuate the actuator when the controller receives a predetermined number of strike signals from the sensor. The actuator may comprise a target actuator and wherein the target actuator turns a target on edge relative to the shooter when the controller receives the predetermined number of strike signals from the sensor. The system may further comprise a target controlled by the actuator, wherein the target has a first, presented position and a second, non-presented position. The actuator may be configured to move the target from the first, presented position to the second, non-presented position when the controller receives the predetermined number of strike signals from the sensor.

According to another aspect, the actuator may comprise a motor and the motor may move the carrier to a home position when the controller receives the predetermined number of strike signals from the sensor.

In some configurations, the sensor comprises a first sensor and a second sensor. The sensor may comprise one or more of: an accelerometer, a piezo electric sensor, a microphone, a thermocouple, and a strain gauge sensor.

The system may further comprise a shooter interface in communication with the controller, wherein the controller is configured to send a warning message to the shooter interface when the controller receives the strike signal from the sensor. The warning message may comprise one or more of an audible sound and a visual alert.

The system may further comprise a range server in communication with the controller, and wherein the controller is configured to send a warning message to the range server when the controller receives the strike signal from the sensor.

Also described herein is a method for protecting a target carrier from hits to the target carrier, the method may comprise: selecting a carrier, the carrier having a strike sensor located thereon; providing a controller in communication with the carrier and the strike sensor, sensing on the strike sensor a strike to the target carrier, and sending a strike signal from the strike sensor to the controller; and taking at least one corrective measure when the controller receives a predetermined number of strike signals from the strike sensor.

The step of selecting a carrier may comprise selecting a carrier having a target actuator for turning a target between a first, presented position and a second, non-presented position. The method may further comprise the step of incrementing the number of strike signals by one for each strike signal received by the controller, and comparing the number of strike signals to a predetermined number of strike signals.

According to one aspect, the method may include the step of sending a warning message to a range server when the controller receives at least one strike signal from the strike sensor. The method may also include the step of sending a warning message to a user interface when the controller receives at least one strike signal from the strike sensor.

The step of taking at least one corrective measure when the controller receives a predetermined number of strike signals from the strike sensor may comprise actuating the actuator to turn the target from the first, presented position to the second, non-presented position.

The step of selecting a carrier may comprise selecting a carrier having a motor and wherein the step of taking at least one corrective measure when the controller receives a predetermined number of strike signals from the strike sensor comprises actuating the motor to move the carrier to a home position. The method may further comprise the step of providing at least one light for a lane of the carrier and controlling the at least one light with the controller, and also the step of the controller making a change to the at least one light of the lane of the carrier when the controller receives the strike signal from the strike sensor.

The predetermined number of strike signals may be, for example, as low as one. According to other configurations, the predetermined number of strike signals may be 1, 2, 3, 4, 5, etc.

According to another aspect, as shown in FIG. 12, a kit 200 is disclosed which may be used to adapt a target carrier 20 that is not capable of detecting hits into a target carrier capable of detecting hits. Such a kit 200 may comprise: a sensor 25 configured to be connected to a controller 30 of the target carrier 20, computer readable storage medium 210 comprising instructions to be carried out by a processor (processor 220 or controller 30) in communication with the sensor and the target carrier, said instructions comprising: the sensor 25 sending a strike signal to the controller 30 when the sensor detects a hit to the target carrier 20; and the processor 30/210 sending a signal to take at least one corrective measure when the controller receives a predetermined number of strike signals. The sensor of the kit may comprise an accelerometer.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. A system for detecting hits to a target carrier comprising:

a target carrier, the target carrier comprising a sensor which detects a strike to the target carrier by a projectile and sends a strike signal to a controller in response to a detected strike;

and a controller in communication with the sensor and the target carrier, the controller being configured to receive the strike signal from the sensor and programed to generate a corrective measure when the strike signal exceeds a predetermined threshold.

2. The system of claim 1, wherein controller is disposed in communication with a target actuator and wherein the controller is programmed to send a signal to the target actuator to turn a target attached to the target actuator on edge relative to a shooter when the controller receives one or more strike signals from the sensor which exceed the predetermined threshold.

3. The system of claim 2, wherein the target actuator is disposed on the target carrier and wherein target carrier comprises a motor and wherein the motor moves the carrier to a home position when the controller receives from the sensor one or more strike signals which exceed the predetermined threshold.

4. The system of claim 1, further comprising a target controlled by the target actuator, wherein the target has a first, presented position and a second, non-presented position.

5. The system of claim 4, wherein the target actuator is configured to move the target from the first, presented position to the second, non-presented position when the controller receives strike signals from the sensor which exceed the predetermined threshold.

6. The system of claim 1, wherein the sensor comprises a first sensor and a second sensor.

7. The system of claim 1, wherein the sensor comprises one of an accelerometer, a piezo electric sensor, a microphone, a thermocouple, and a strain gauge sensor.

8. The system of claim 1, further comprising a shooter interface in communication with the controller, wherein the corrective measure comprises the controller sending a warning message to the shooter interface when the controller receives one or more strike signals from the sensor.

9. The system of claim 8, wherein the warning message comprises one or more of an audible sound and a visual alert.

10. The system of claim 1, further comprising a range server in communication with the controller, and wherein the controller is configured to send a warning message to the range server when the controller receives the strike signal from the sensor.

11. The system of claim 1, wherein the carrier further comprises a camera, the camera in communication with the controller.

12. A method for protecting a target carrier from hits to the target carrier, the method comprising:

selecting a carrier, the carrier having a strike sensor located thereon;

providing a controller in communication with the carrier and the strike sensor, sensing a strike to the target carrier with the strike sensor, and sending a strike signal to the controller;

the controller generating at least one corrective measure in response to one or more strike signals exceeding a predetermined threshold.

13. The method of claim 12, wherein the step of selecting the carrier comprises selecting a carrier having a target actuator for turning a target between a first, presented position and a second, non-presented position.

14. The method of claim 13, wherein the step of generating at least one corrective measure when the controller receives at least one strike which exceeds a predetermined threshold from the strike sensor comprises actuating the target actuator to turn the target from a first, presented position to a second, non-presented position.

15. The method of claim 12, further comprising the step of incrementing the number of strike signals by one for each strike signal received by the controller.

16. The method of claim 15, further comprising comparing the number of strike signals to a predetermined number of strike signals.

17. The method of claim 12, wherein the step of generating at least one corrective measure comprises the step of sending a warning message to a range server when the controller receives at least one strike signal from the strike sensor.

18. The method of claim 12, wherein the step of generating at least one corrective measure comprises comprising the step of sending a warning message to a user interface when the controller receives at least one strike signal from the strike sensor which exceeds the predetermined threshold.

19. The method of claim 12, wherein the step of selecting the carrier comprises selecting a carrier having a motor and wherein the step of generating at least one corrective measure when the controller receives at least strike signal exceeding a predetermined threshold comprises actuating the motor to move the carrier to a home position.

20. The method of claim 12, further comprising the step of providing at least one light for a lane of the carrier and controlling the at least one light with the controller, and further comprising the step of the controller making a change to the at least one light of the lane of the carrier when the controller receives the strike signal from the strike sensor.

21. The method of claim 12, wherein the predetermined threshold for number of strike signals from the strike sensor is zero.

22. A kit for adapting a target carrier to detect hits to the target carrier, the kit comprising:

a sensor configured to be connected to a controller of the target carrier, computer readable storage medium comprising instructions to be carried out by a processor in communication with the sensor and the target carrier, said instructions comprising:

the sensor sending a strike signal to the controller when the sensor detects a hit to the target carrier; and the processor sending a signal to take at least one corrective measure when the controller receives one or more strike signals exceeding a predetermined threshold.

23. The kit of claim 22, wherein the sensor comprises an accelerometer.

24. The kit of claim 22, further comprising a camera configured to be connected to the controller of the target carrier.

* * * * *